United States Patent [19]

Konstant

[11] 4,030,611

[45] June 21, 1977

[54] ADJUSTABLE STORAGE RACKS

[75] Inventor: Anthony N. Konstant, Mount Prospect, Ill.

[73] Assignee: Speedrack Inc., Skokie, Ill.

[22] Filed: June 15, 1976

[21] Appl. No.: 696,301

[52] U.S. Cl. ..... 211/191; 211/182

[51] Int. Cl.[2] ..... A47F 5/10

[58] Field of Search ..... 211/92, 189, 182, 191, 211/134, 186, 187, 175, 207, 208, 192; 248/188.2; 52/648, 632, 650, 656; 108/106, 107, 109

[56] References Cited

UNITED STATES PATENTS

| | | | |
|---|---|---|---|
| 1,315,656 | 9/1919 | Burgener | 211/182 UX |
| 2,462,321 | 2/1949 | Holmes | 211/208 X |
| 3,186,527 | 6/1965 | Konstant et al. | 211/192 X |
| 3,963,290 | 6/1976 | Rennemann | 211/191 X |

*Primary Examiner*—Ramon S. Britts
*Assistant Examiner*—Robert W. Gibson, Jr.
*Attorney, Agent, or Firm*—Fitch, Even, Tabin & Luedeka

[57] ABSTRACT

An adjustable storage rack utilizing end frames wherein front and rear columns are interconnected to provide fixed fore-and-aft spacing. The columns are apertured at spaced intervals to attach beams having mating connectors. The columns include apertured vertical members which are shortened to terminate substantially above the floor plus unapertured posts which extend to the floor and overlap with each other along a distance preferably at least equal to the shortened distance. The upper ends of the posts are closed while the bottom ends of apertured members are open.

8 Claims, 4 Drawing Figures

ADJUSTABLE STORAGE RACKS

The present invention relates to adjustable storage racks and more particularly to an improved end frame for use in adjustable storage racks.

A large number of different connecting devices have been developed for joining a horizontal beam to a vertical column, and these connectors have found use in adjustable storage racks of various types, particularly those sometimes referred to as pallet racks. Nearly all of these different types of connectors utilize apertures at spaced vertical locations which are formed, usually by punching, in one or more of the walls of the column. These spaced apertures provide adjustability and allow beams to be located at different vertical heights, or subsequently repositioned, depending upon the particular product being stored. A shaped connector element welded to the end of the beam may directly engage the apertures in the column, or a separate pin device may first be inserted at the desired vertical location which is in turn engaged by a connector element at the end of the beam.

One particularly effective connector is shown in U.S. Pat. No. 2,932,368 issued to Burt E. Schell, Jr. on Apr. 12, 1960, which upon loading locks the beam to the column in two directions spaced 90° from each other. However, in this and in all other such adjustable storage racks wherein the adjustability is provided via the employment of apertured vertical columns, the presence of the apertures inherently slightly weakens the column at each aperture location. Moreover, the presence of such apertures provides an entrance through which dirt or other foreign matter can accumulate in the columns, and depending upon the items being stored, for example, food products, there is a possibility that rodents or other vermin could nest inside such apertured columns.

It is an object of the present invention to provide an improved adjustable storage rack which provides greater structural strength while retaining the desired adjustability. Another object of the invention is to provide an improved adjustable storage rack which is designed to promote ease in maintaining a high degree of cleanliness. Yet another object of the invention is to provide an improved storage rack which retains adjustability while providing excellent structural strength in regions most subject to damage and ease in housekeeping maintenance. These and other objects of the invention should be apparent from the following detailed description of a preferred construction embodying various features of the invention, when read in combination with the accompanying drawings wherein:

Figure 1:
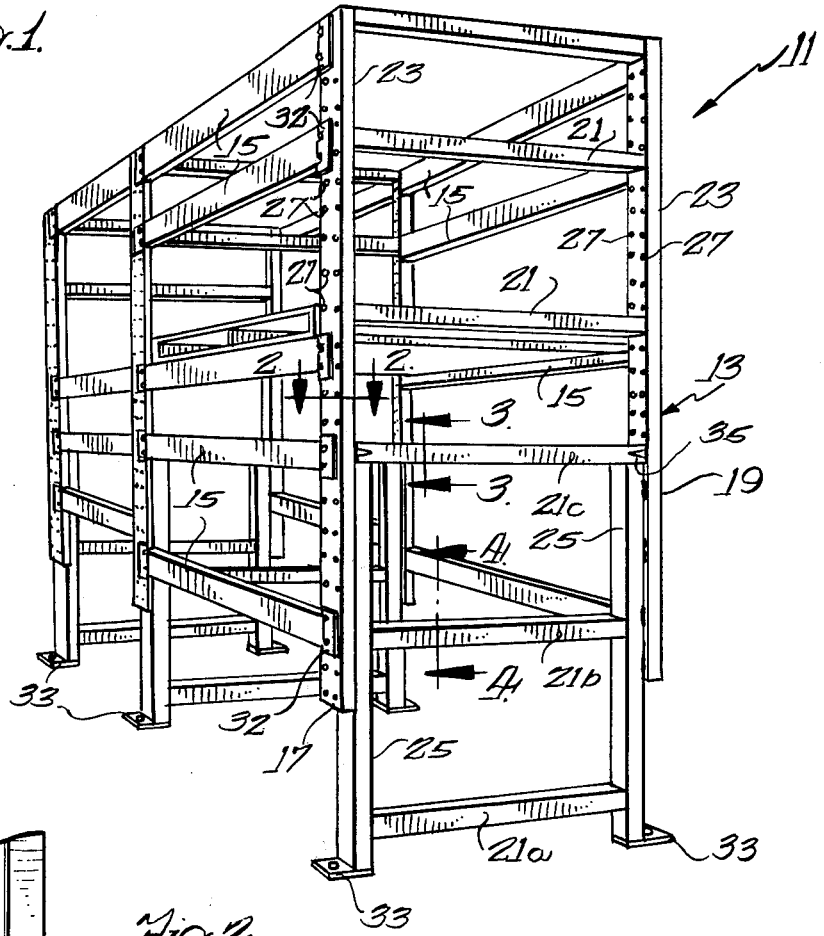
FIG. 1 is a perspective view of a storage rack installation embodying various features of the invention.

As seen in FIG. 1, the invention provides an adjustable storage rack wherein an end frame is made by terminating the apertured vertical members a substantial distance above the floor and welding unapertured tubes thereto. The end frames are designed so that there is overlapping in each of the columns along a substantial region including the location where the lowermost load-carrying beam will be connected. This construction also allows the employment of a heavier gauge steel in the unapertured supporting tube which can better withstand contact by mechanical lift equipment without sustaining structural damage. Moreover, a significant additional advantage which accompanies the construction is that the tubular supporting subframe can be completely closed so that its interior is sealed from the possibility of contamination, while the bottom of each of the apertured vertical members is left open so that contamination cannot collect in the bottoms and access for periodic cleaning is also provided.

Illustrated in the drawings is an adjustable storage rack 11 which includes a pair of end frames 13 which are interconnected by horizontally extending beams 15. Any number of such end frames can be used in a storage array, and individual columns may be used between some end frames 13 where the overall storage rack array will have good fore-and-aft stability.

Each of the end frames 13 includes a front vertical column 17 and a rear vertical column 19 which are spaced apart, in a fore-and-aft direction, by a plurality of braces 21 which are preferably completely closed hollow tubes, although other structural shapes, e.g., channels, I- or Z-beams, could be used. The front and rear vertical columns are composite members made up of an upper apertured vertical 23 and a lower post 25 which is in the form of a hollow completely closed tube. The illustrated upper apertured vertical 23 is a complete tube; however, it could be generally C-shaped in cross section as illustrated in the above-identified patent.

Figure 2:
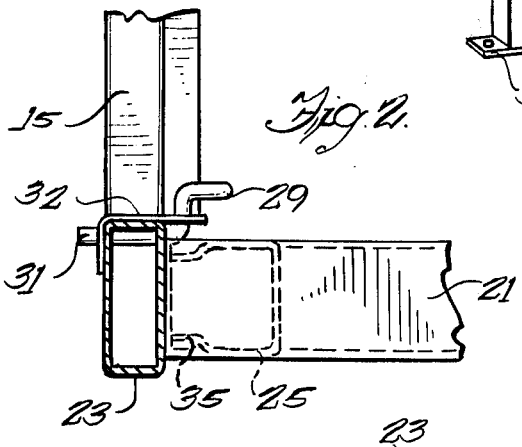
FIG. 2 is an enlarged sectional view taken looking down along line 2—2 of FIG. 1.

The front and rear surfaces of the tubular verticals 23 are provided with aligned holes 27, at spaced vertical intervals, arranged in rows along both of the lateral edges thereof. For example, the holes 27 may be located at two-inch vertical intervals when connecting pins 29, which are inserted from the inward side of the column through to the exterior or front face, have pin sections 31 which are four inches apart. Thus, the pin sections 31 will register with two holes that flank any single hole in the vertical row. A connector 32 is welded to the end of each beam 15, and it engages both pin sections 31 in planes at right angles to each other as best seen in FIG. 2. The cross section of the posts 25 is chosen so that they will have a dimension sufficiently less than the width of the apertured tube 23 so that there is no interference with the insertion of the connecting pins 29 through the holes 27. In this respect, the post 25 is suitably affixed to the inward surface of the apertured vertical 23, in any suitable manner, but usually by tack welding at spaced regions between the holes 27 so that the weld metal does not create interference.

In the illustrated embodiment, there are three horizontal braces 21 which are suitably affixed, as by welding, to the two posts 25 to create a subassembly or subframe. The lowermost brace **21*a* is located just above the floor, and an intermediate brace 21*b* is located a short distance above the bottom of the apertured vertical and in the approximate region where the lowermost load-bearing beam 15 is intended to be attached. The uppermost brace 21*a* is slightly longer than the other two and is welded to the tops of the two posts 25, as well as to the inward-facing surfaces of the apertured vertical members 23. As a result of this arrangement, the brace 21***c* closes the tops of the two posts 25 and, following the welding operation, provides a completely sealed subframe. The lower ends of the posts are provided with bearing plates 33, to the upper surfaces of which they are suitably attached as by welding.

Figure 3:
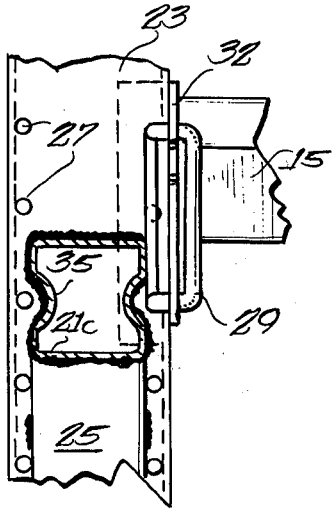
FIG. 3 is an enlarged sectional view taken looking horizontally generally along the line 3—3 of FIG. 1.
Figure 4:
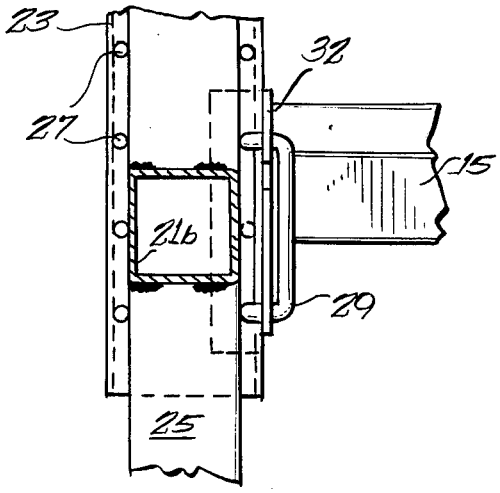
FIG. 4 is an enlarged sectional view taken looking horizontally generally along the line 4—4 of FIG. 1.

As best seen in FIGS. 2 and 3, the ends of the uppermost horizontal brace 21*c* is provided with inwardly extending depressions or dimples 35 which are positioned at a horizontal level which will match the location of the adjacent aperture 27 in the vertical member 23. As a result, a continuous weld can be formed about the two side surfaces and the top to join this brace to the inward surface of the apertured vertical 23 without having the weld metal interfere with access to the hole 27 at this level. In addition, the line of joinder between the undersurface of the brace 21*c* and the top of the post 15 is welded to completely close the post. Although the end frame 13 is depicted as having all of its bracing in the form of horizontal tubes, thus forming what is referred to as a Vierendeel truss, diagonal braces and/or X-bracing can also be employed if desired to provide even greater stability against racking in the fore-and-aft planes. In regions prone to the occurrence of earthquakes, there are advantages which flow from using Vierendeel trusses.

The apertured vertical members 23 are shortened to terminate a substantial distance above the floor, which should be at least about 2 feet and preferably about 3 feet or more. The overlapping region between the post 25 and the apertured vertical member 23 should be at least as great as the distance the apertured vertical is terminated above the floor, or in other words the height of the post should be equal to more than twice the shortened distance.

It has been found that when there is an inadvertent collision or contact between a piece of power-driven lift equipment and the front column 17 of a storage rack, the main stress is imparted to the rack at the point of attachment of the lowermost load-supporting beam, and it is there that the damage occurs. The design of the end frames 13 is such that the lowermost load-carrying beam 15 will be located in the region where the apertured vertical member 23 and the post 25 overlap so that the combined structural rigidity of the two welded members 23,25 is present to combat such potential stress. It has been found that the added rigidity of a double tubular arrangement is extremely effective in withstanding the potential concentrated stress which may be imparted at the point of attachment of the lowermost load-carrying beam 15. A complete unapertured tube may have more than 200 times the torsion resistance than would a post 25 made of a different structural shape, and as a result, adjustable storage racks 11 of the illustrated design have proved to be excellently resistant to damage from inadvertent glancing blows from lift-trucks and the like.

Although, for uniformity purposes, it is preferred to extend both posts 25 to the same height so that both the front and rear post can be closed at its respective top by welding to the underside of the horizontal tubular brace 21*c*, protection against the effects of a collision is only required in the front columns 17 adjacent the aisle wherein power-driven lift equipment will be operated. Accordingly, the rear vertical column 19, which will usually be adjacent a wall or arranged in back-to-back formation with another such array of storage racks, would not require this protection. Accordingly, it is possible to use a shorter rear post 25. For example, it could be terminated a short distance above the intermediate brace 21*b*, and its upper end could be suitably capped by welding a plate thereto.

The preferred configuration for the apertured vertical member 23 is that of a rectangular cross section tube which provides adequate strength while spreading the rows of holes 27 along both lateral edges. However, a column having essentially a square cross section can provide superior resistance to transverse bending stresses as might result from an inadvertent collision, and thus the illustrated construction combines a square cross section shape with a rectangular cross section shape in the locations in the column construction where each exhibits its best qualities with excellent results. Moreover, a heavier gauge material can be used for the posts in the region where it provides collision resistance without having to use this heavier material throughout the entire height of the end frame where such additional strength would be superfluous.

It also can be seen that the illustrated adjustable storage rack 11 utilizes a completely closed subframe which serves as a positive deterrent to the accumulation of dirt or the infestation by vermin, especially rodents. Thus, the design provides a substantial advantage from a maintenance standpoint, and this can be a very important advantage where food product storage is involved and it is necessary to clean the interior of the columns. The open bottom ends of the vertical member 23 at a location some 3 or so feet above floor level provide a convenient entrance for daily cleaning.

Although the invention has been described with regard to a preferred embodiment, it should be understood that various modifications may be made to the illustrated adjustable storage rack as would be obvious to those having the ordinary skill in the art without departing from the scope of the invention which is set forth solely in the appended claims. Various of the features of the invention are set forth in the claims which follow.

What is claimed is:

1. An adjustable storage rack which comprises an end frame having front and rear columns which are interconnected with each other to achieve a fixed fore-and-aft spacing, said columns including aperture means at spaced vertical intervals for the attachment of horizontal beams having connectors for mating connection therewith, wherein the improvement comprises said columns including apertured vertical members which extend downward from the top of said end frame but which terminate a substantial distance above the floor, and also including a pair of vertical posts which extend to the floor and the upper portions of which are affixed to the inward surfaces of said apertured members to provide an overlapping region, said posts being unapertured tubes the upper ends of which are closed, while the bottom ends of said apertured vertical members are open.

2. An adjustable storage rack in accordance with claim 1 wherein a tubular brace extends rearward from said front column and wherein the top of said front column post is closed as a result of being welded to the underside of said tubular brace.

3. An adjustable storage rack in accordance with claim 1 wherein said front column post is attached to said apertured member along a distance at least about as long as the distance above the floor which said apertured member is terminated.

4. An adjustable storage rack in accordance with claim 1 wherein the bottom ends of said posts are closed by bearing plates which rest upon the floor.

5. An adjustable storage rack in accordance with claim 1 wherein said posts are fixedly interconnected by the ends of first and second closed tubes to form a truss subassembly with said second tube being located above said first tube and being connected to said posts in said overlapping region and a short distance above the lower end of said vertical members.

6. An adjustable storage rack in accordance with claim 5 wherein a third closed tube extends between and is affixed to said columns at a location above said second tube and closes the top of at least one of said posts.

7. An adjustable storage rack in accordance with claim 3 wherein rows of said apertures are disposed along both lateral edges of the front and rear surfaces of said vertical members and wherein the lateral dimension of said post is less than the horizontal distance between said rows.

8. An adjustable storage rack in accordance with claim 7 wherein said posts are made of tubes of square cross section.

* * * * *